US006389657B1

(12) United States Patent
Turner

(10) Patent No.: US 6,389,657 B1
(45) Date of Patent: May 21, 2002

(54) SOCK CLIP

(76) Inventor: Darlyn C. Turner, 2601 Country Club Dr., Olympia Fields, IL (US) 60461

( * ) Notice: Subject to any disclaimer, the term of this patent is extended or adjusted under 35 U.S.C. 154(b) by 7 days.

(21) Appl. No.: 09/633,569

(22) Filed: Aug. 4, 2000

(51) Int. Cl.[7] ..... A44B 21/00

(52) U.S. Cl. ..... 24/334; 24/510; 24/DIG. 29; 223/96

(58) Field of Search ..... 24/334, 499, 500, 24/501, 507, 508, 509, 510, 511, 564, DIG. 29, DIG. 9; 223/96; 248/317; 211/113, 85.3

(56) References Cited

U.S. PATENT DOCUMENTS 1,281,913 A * 10/1918 Curley ..... 24/510
1,420,654 A * 6/1922 Grant ..... 24/334 X
2,629,154 A * 2/1953 Micuci ..... 24/334 X
3,091,828 A * 6/1963 Soltis ..... 24/507 X
3,456,262 A * 7/1969 Coon ..... 24/501
3,774,267 A 11/1973 Sneider
4,763,389 A * 8/1988 Chang ..... 24/67.7 X
5,038,413 A 8/1991 Ursino
5,357,660 A 10/1994 Smith
5,440,791 A 8/1995 Guio
5,499,431 A 3/1996 Mortensen et al.
5,551,128 A * 9/1996 Townsend ..... 24/DIG. 29
D410,302 S 5/1999 Yasuda
6,119,906 A * 9/2000 Bond et al. ..... 223/96

* cited by examiner

*Primary Examiner*—Robert J. Sandy

(57) ABSTRACT

A sock clip for holding a pair of socks together through a laundry cycle to prevent the need for matching socks after the laundry cycle. The sock clip includes a pair of arms. Each of the arms has a proximal end and a distal end. Each of the distal ends has a plurality of teeth integrally attached thereto and extending away therefrom. An urging means pivotally couples together the arms together and urges the distal ends together.

11 Claims, 6 Drawing Sheets

SOCK CLIP

BACKGROUND OF THE INVENTION

1. Field of the Invention

The present invention relates to clips and more particularly pertains to a new sock clip for holding a pair of socks together through a laundry cycle to prevent the need for matching socks after the laundry cycle.

2. Description of the Prior Art

The use of clips is known in the prior art. More specifically, clips heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,440,791; 3,774,267; 5,357,660; 5,038,413; 5,499,431; and U.S. Pat. No. Des. 410,302.

While these devices fulfill their respective, particular objectives and requirements, the aforementioned patents do not disclose a new sock clip. The inventive device includes a pair of arms. Each of the arms has a proximal end and a distal end. Each of the distal ends has a plurality of teeth integrally attached thereto and extending away therefrom. An urging means pivotally couples together the arms together and urges the distal ends together.

In these respects, the sock clip according to the present invention substantially departs from the conventional concepts and designs of the prior art, and in so doing provides an apparatus primarily developed for the purpose of holding a pair of socks together through a laundry cycle to prevent the need for matching socks after the laundry cycle.

SUMMARY OF THE INVENTION

In view of the foregoing disadvantages inherent in the known types of clips now present in the prior art, the present invention provides a new sock clip construction wherein the same can be utilized for holding a pair of socks together through a laundry cycle to prevent the need for matching socks after the laundry cycle.

The general purpose of the present invention, which will be described subsequently in greater detail, is to provide a new sock clip apparatus and method which has many of the advantages of the clips mentioned heretofore and many novel features that result in a new sock clip which is not anticipated, rendered obvious, suggested, or even implied by any of the prior art clips, either alone or in any combination thereof.

To attain this, the present invention generally comprises a pair of arms. Each of the arms has a proximal end and a distal end. Each of the distal ends has a plurality of teeth integrally attached thereto and extending away therefrom. An urging means pivotally couples together the arms together and urges the distal ends together.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new sock clip apparatus and method which has many of the advantages of the clips mentioned heretofore and many novel features that result in a new sock clip which is not anticipated, rendered obvious, suggested, or even implied by any of the prior art clips, either alone or in any combination thereof.

It is another object of the present invention to provide a new sock clip which may be easily and efficiently manufactured and marketed.

It is a further object of the present invention to provide a new sock clip which is of a durable and reliable construction.

An even further object of the present invention is to provide a new sock clip which is susceptible of a low cost of manufacture with regard to both materials and labor, and which accordingly is then susceptible of low prices of sale to the consuming public, thereby making such sock clip economically available to the buying public.

Still yet another object of the present invention is to provide a new sock clip which provides in the apparatuses and methods of the prior art some of the advantages thereof, while simultaneously overcoming some of the disadvantages normally associated therewith.

Still another object of the present invention is to provide a new sock clip for holding a pair of socks together through a laundry cycle to prevent the need for matching socks after the laundry cycle.

Yet another object of the present invention is to provide a new sock clip which includes a pair of arms. Each of the arms has a proximal end and a distal end. Each of the distal ends has a plurality of teeth integrally attached thereto and extending away therefrom. An urging means pivotally couples together the arms together and urges the distal ends together.

Still yet another object of the present invention is to provide a new sock clip that includes a storage device which may be hung over an edge of a hamper or other area while holding a plurality of sock clip devices.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
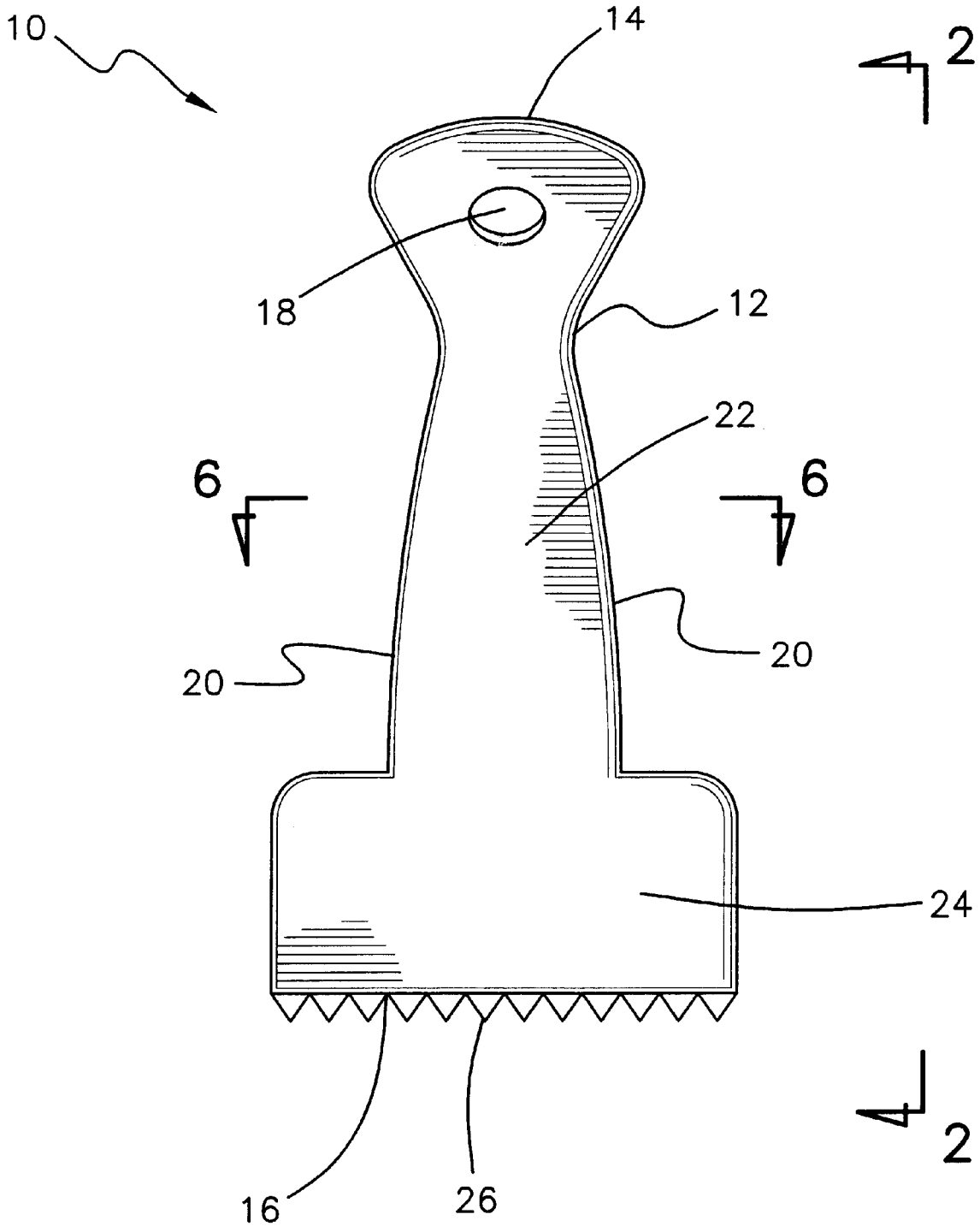
FIG. 1 is a schematic front view of a new sock clip according to the present invention.
Figure 2:
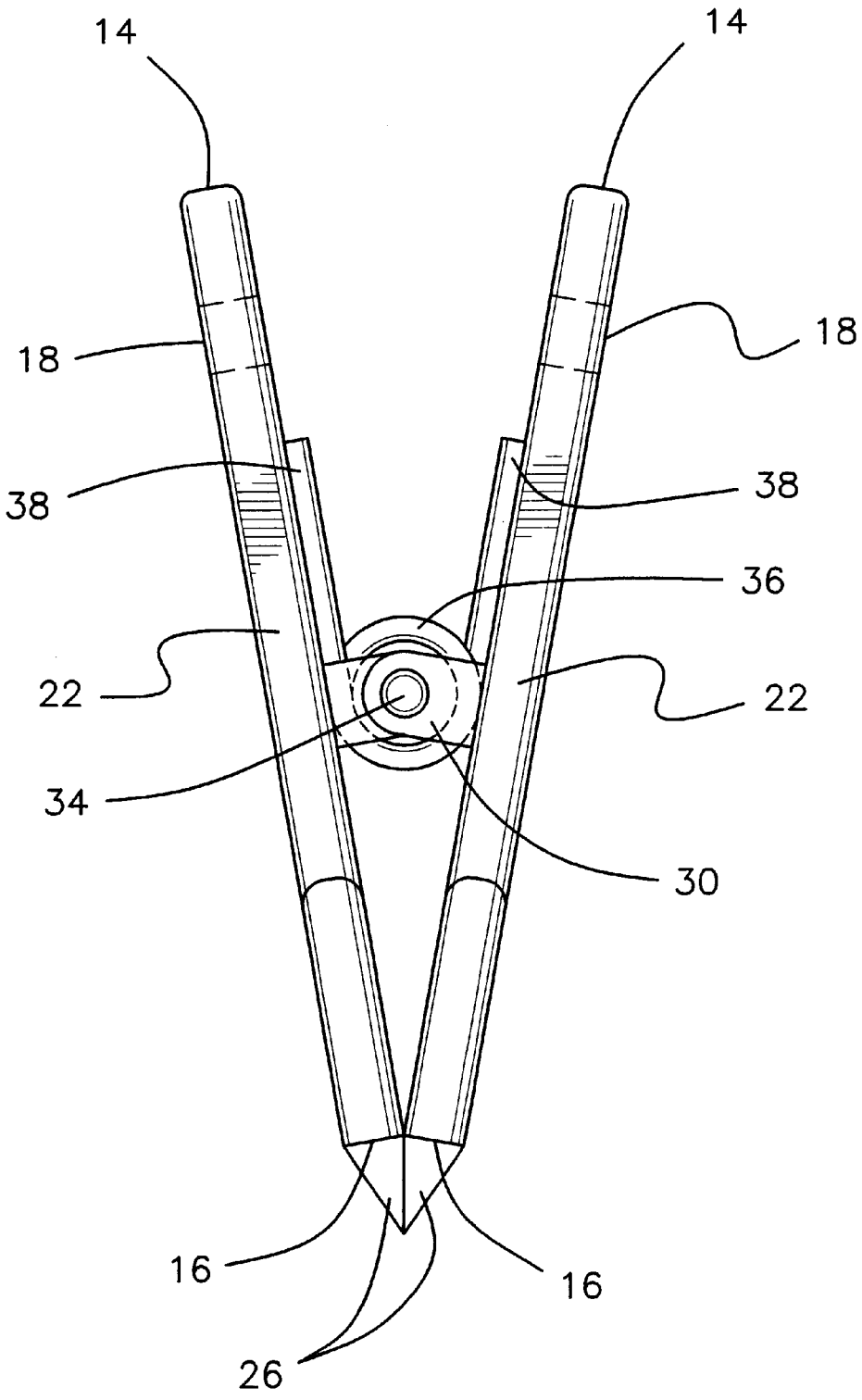
FIG. 2 is a schematic side view of the present invention.
Figure 3:
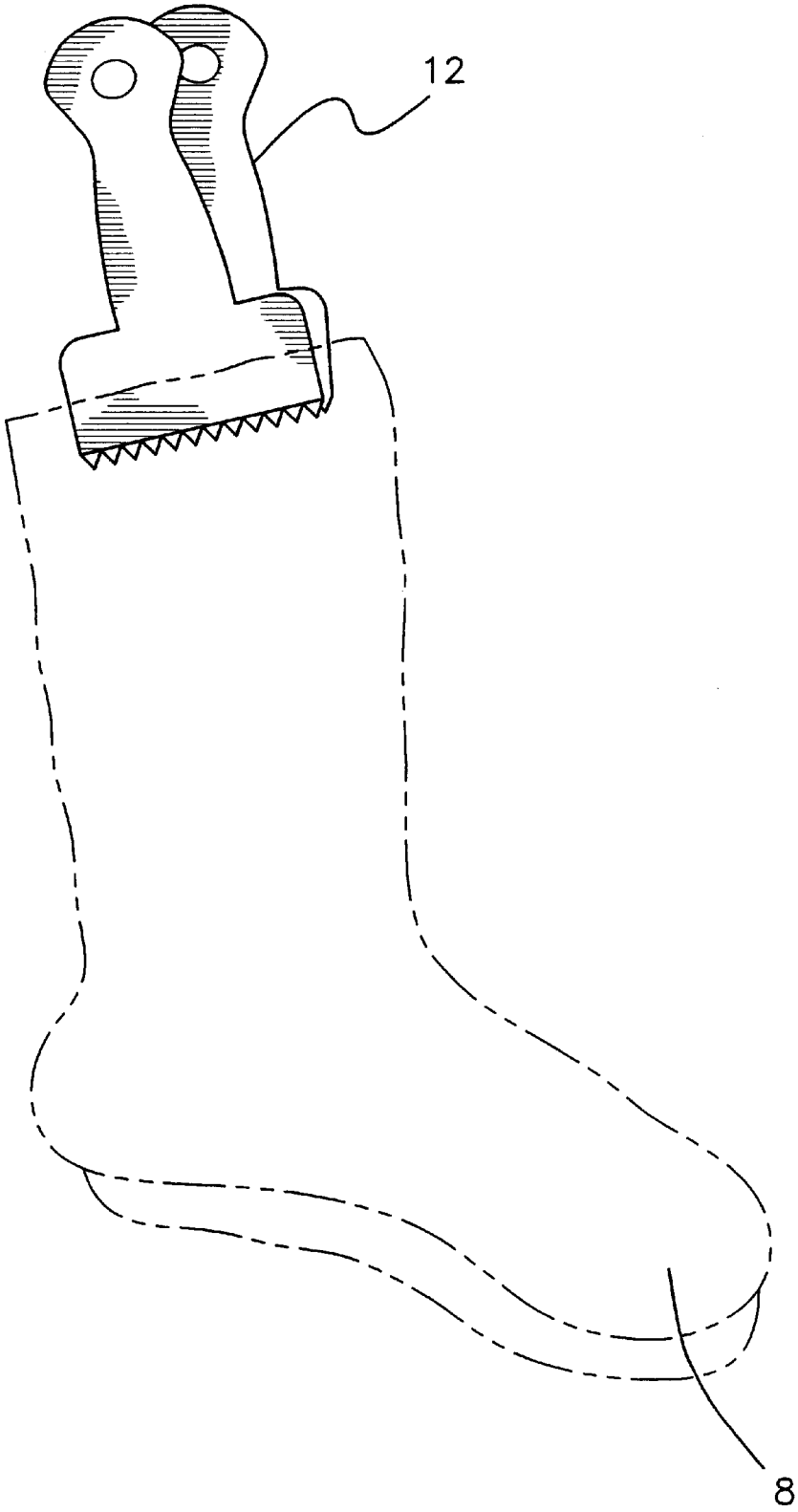
FIG. 3 is a schematic in use view of the present invention.
Figure 4:
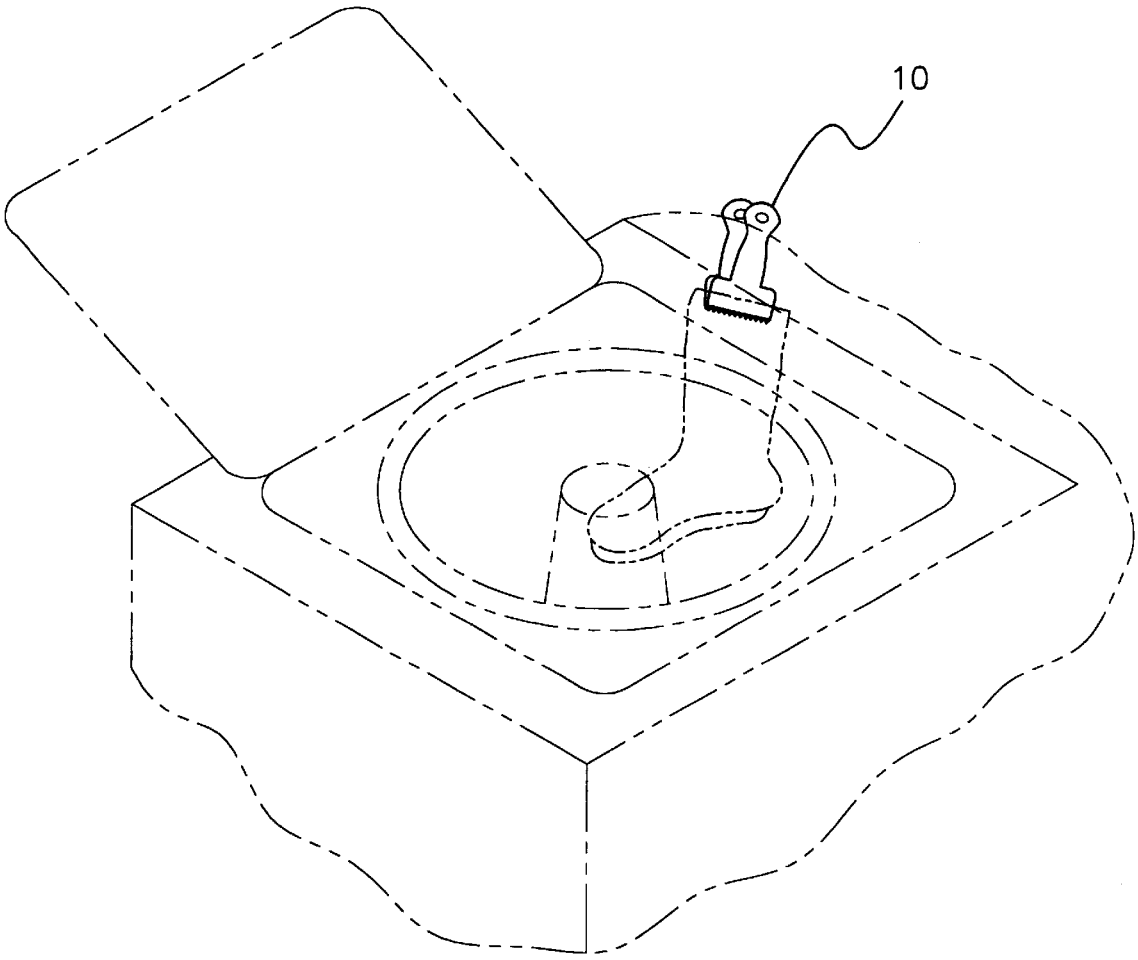
FIG. 4 is a schematic in use view of the present invention.
Figure 5:
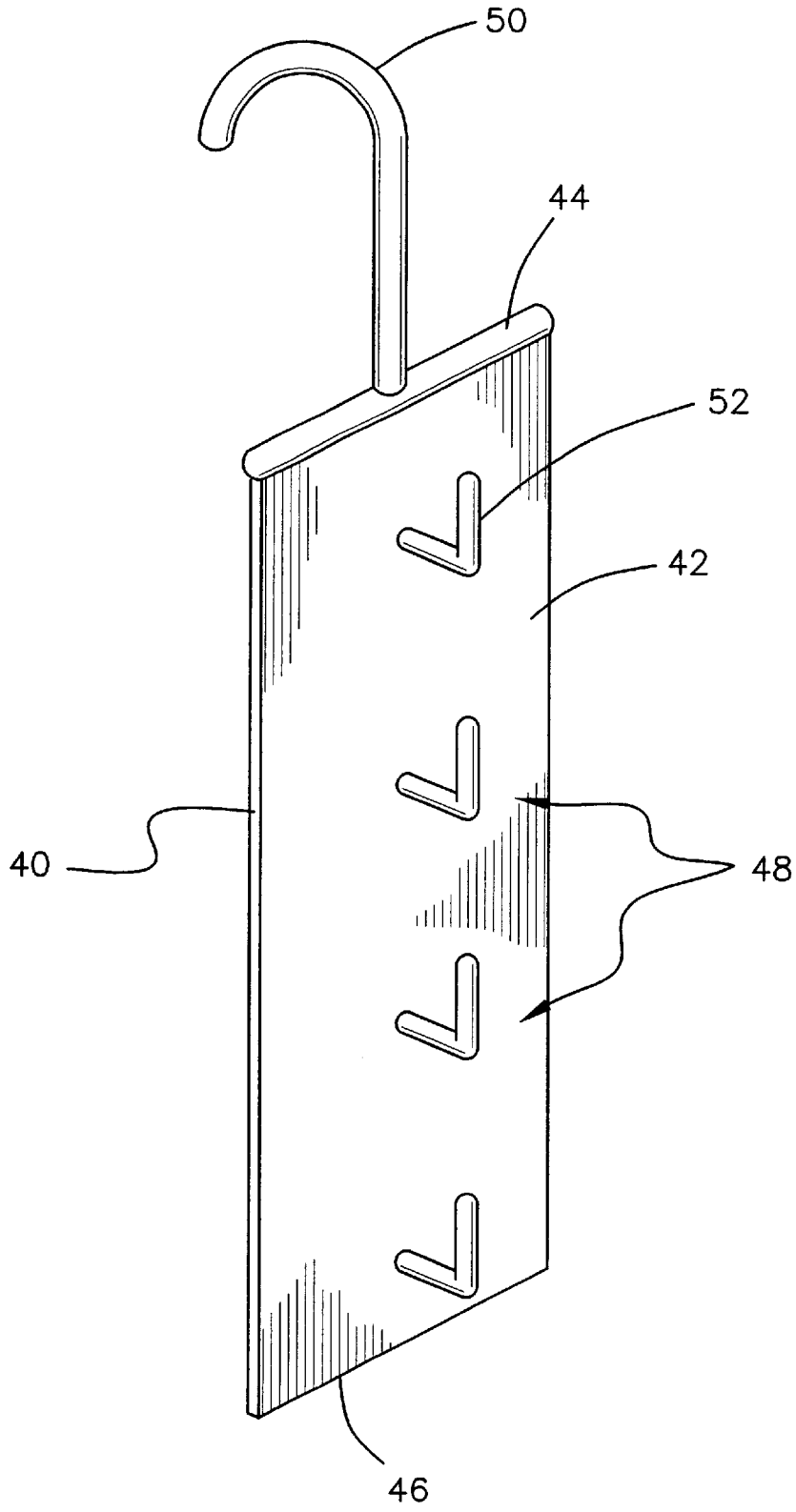
FIG. 5 is a schematic perspective view of the storing device of the present invention.
Figure 6:
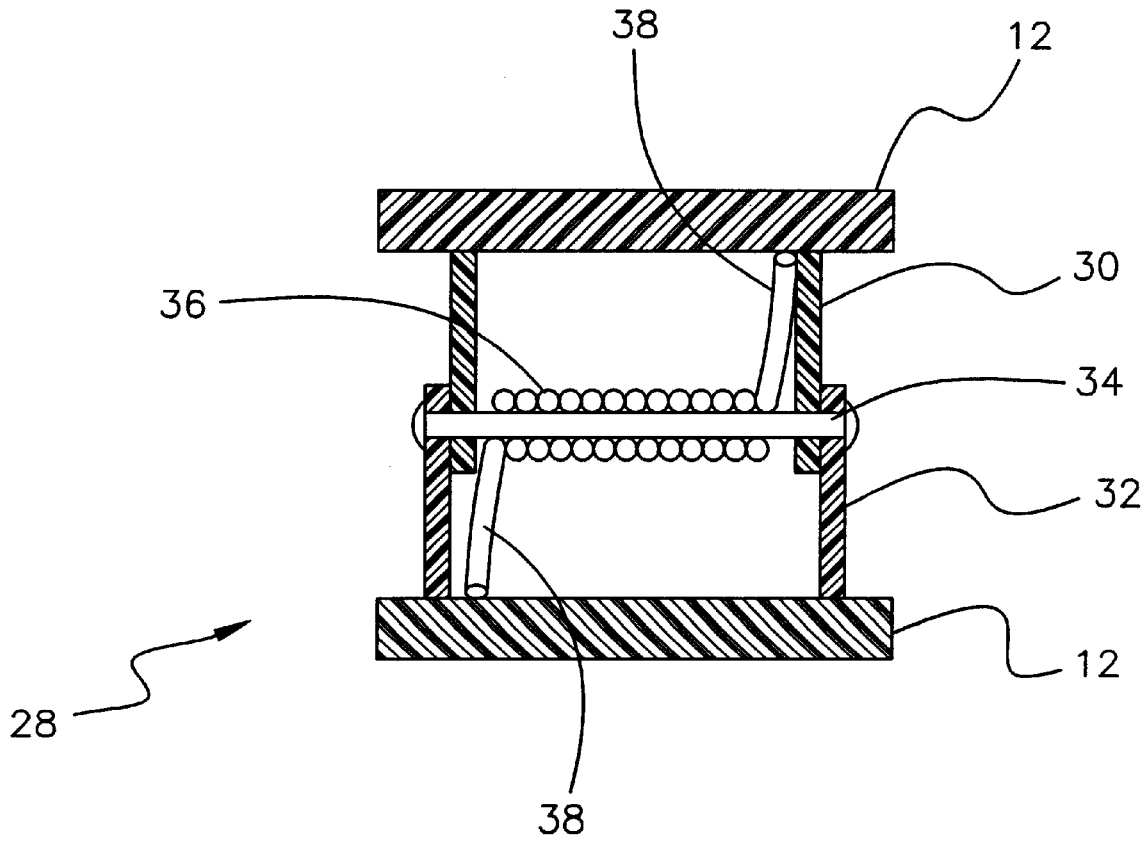
FIG. 6 is a schematic cross-sectional view taken along line 6—6 of the present invention.

With reference now to the drawings, and in particular to FIGS. 1 through 6 thereof, a new sock clip embodying the principles and concepts of the present invention and generally designated by the reference numeral 10 will be described.

As best illustrated in FIGS. 1 through 6, the sock clip 10 generally comprises a pair of arms 12. Each of the arms 12 has a proximal end 14 and a distal end 16. Each of the arms 12 has a hole 18 therethrough. Each of the holes 18 is nearer the proximal ends 14 than the distal ends 16. The proximal ends 14 are preferably arcuate. The distal ends 16 are elongate. Each of the arms 12 has a pair of side edges 20. The side edges 20 of each of the arms 12 are contoured so that a middle portion 22 of each of the arms has a width less than a width of each of the proximal 14 and distal 16 ends. An area 24 between the distal ends 16 and the middle portions 22 generally has a rectangular shape.

Each of the distal ends 16 has a plurality of teeth 26 integrally attached thereto and extending away therefrom. A cross-section of each of the teeth 26 taken perpendicular to a plane of the arms 12 generally has a triangular shape such that a base of each of the triangles is abutted against one of the distal ends 16.

An urging means 28 urges the distal ends 16 together. The urging means 28 includes two pairs of protruding members 30. Each pair of the protruding members 30 is integrally coupled to and extends away from one of the middle portions 22 of the arms 12. Each protruding member 30 in a pair of protruding members is spaced from each other. Each of the protruding members 30 has an aperture 32 therein.

A rod 34 extends through the apertures 32 in each pair of protruding members 30 such that the arms 12 are pivotally coupled together.

A biasing means 36 biases the proximal ends 14 away from each other. The biasing means 36 preferably comprises a spring wrapped about the rod 34. Each end 38 of the spring is abutted against one of the arms 12. Each of the ends 38 of the spring extends toward one of the proximal ends 14 of the arms 12.

A plate 40 has a front side 42, a back side, a top edge 44 and a bottom edge 46. A plurality of hook members 48 is integrally coupled to the plate. A first 50 of the hook members 48 is coupled to extends away from the top edge 44 of the plate. The first hook member 48 generally resembles the hook on a conventional hanger. A plurality of second hook members 52 is coupled to the front side 42 of the plate 40 and each generally has an L-shaped configuration directed upwardly. The second hook members may extend through the holes 18 in the arms 12 to store a plurality of sock holding devices 10 without or without socks 8 releasably coupled thereto.

In use, two single articles of hosiery 8 comprising a matched pair are inserted between the distal ends 16 of the arms. The distal ends 16 are urged together to hold the pair therebetween. The device 10 and the pair of socks 8, stockings or hose are passed through a laundry cycle. The device 10 keeps the pair of socks together so that the socks need not be matched.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A clip device for the securing together of single socks, stockings and hose to form a matched pair thereof, said device comprising:

a pair of arms, each of said arms having a proximal end and a distal end;

each of said distal ends having a plurality of teeth integrally attached thereto and extending away therefrom, each of said teeth having an outer side and an inner side wherein said inner sides of said teeth on a first of said arms are facing said inner sides of said teeth on a second of said arms, said inner sides being generally planar, each of said teeth on the first of said arms being aligned with one of said teeth on the second of said arms such that the inner surfaces of aligned teeth abut when said distal ends are positioned adjacent to each other; and an urging means pivotally couples the arms together and urges said distal ends together.

2. The clip device as in claim 1, wherein said proximal ends of said arms are generally arcuate, each of said distal ends being elongate.

3. The clip device as in claim 1, wherein each of said arms has a pair of side edges being contoured such that a middle portion of each of said arms has a width less than a width of each of said proximal and distal ends, an area between said distal ends and said middle portions generally having a rectangular shape.

4. The clip device as in claim 1, wherein a cross-section of each of said teeth taken perpendicular to a plane of said arms generally has a triangular shape such that a base of each of said triangles is abutted against one of said distal ends.

5. The clip device as in claim 1, wherein said urging means comprises:

each of said arms having a middle portion positioned between said proximal and distal ends;

two pairs of protruding members, each pair of said protruding members being integrally coupled to and extending away from one of said middle portions of said arms, each protruding member in a pair of protruding members being spaced from each other, each of said protruding members having an aperture therein;

a rod, said rod extending through said apertures in each pair of protruding members such that said arms are pivotally coupled together;

a biasing means biases said proximal ends away from each other, said biasing means being wound about said rod.

6. A clip device and storage system for the securing together of single socks, stockings and hose to form a matched pair thereof, said device comprising:

a pair of arms, each of said arms having a proximal end and a distal end, each of said arms having a hole therethrough, each of said holes being nearer said proximal ends than said distal ends, each of said proximal ends being generally arcuate, each of said distal ends being elongate, each of said arms having a pair of side edges, said side edges of each of said arms being contoured such that a middle portion of each of said arms has a width less than a width of each of said proximal and distal ends, an area between said distal ends and said middle portions generally having a rectangular shape;

each of said distal ends having a plurality of teeth integrally attached thereto and extending away therefrom, a cross-section of each of said teeth taken perpendicular to a plane of said arms generally having a triangular shape such that a base of each of said triangles is abutted against one of said distal ends;

an urging means for urging said distal ends together, said urging means comprising;

two pairs of protruding members, each pair of said protruding members being integrally coupled to and extending away from one of said middle portions of said arms, each protruding member in a pair of protruding members being spaced from each other, each of said protruding members having an aperture therein;

a rod, said rod extending through said apertures in each pair of protruding members such that said arms are pivotally coupled together;

a biasing means biases said proximal ends away from each other, said biasing means comprising a spring wrapped about said rod, each end of said spring being abutted against one of said arms, each of said ends of said spring extending toward one of said proximal ends of said arms;

a plate, said plate having a front side, a back side, a top edge and a bottom edge, a plurality of hook members being integrally coupled to said plate, a first of said hook members being coupled to and extending away from said top edge of said plate, each of a plurality of second hook members being coupled to said front side of said plate, wherein said second hook members on said front side of said plate may extend through said holes in said arms; and wherein two single articles comprising a matched pair are inserted between said distal ends of said arms, said distal ends are urged together to hold said pair therebetween, wherein said device and said pair are passed through a laundry cycle.

7. A clip device for the securing together of single socks, stockings and hose to form a matched pair thereof, said device comprising:

a pair of arms, each of said arms having a proximal end and a distal end, each of said arms having a hole extending therethrough;

each of said distal ends having a plurality of teeth attached thereto and extending away therefrom;

an urging means pivotally couples the arms together and urges said distal ends together;

a plate having a front side, a back side, a top edge and a bottom edge, a plurality of hook members being integrally coupled to said plate, a first of said hook members being coupled to and extending away from said top edge of said plate, each of a plurality of second hook members being coupled to said front side of said plate, wherein said second hook members on said front side of said plate may extend through said holes in said arms; and wherein two single articles comprising a matched pair may be inserted between said distal ends of said arms, said distal ends are urged together to hold said pair therebetween, wherein said device and said pair are passed through a laundry cycle.

8. The clip device as in claim 7, wherein each of said arms is generally arcuate, each of said distal ends being elongate.

9. The clip device as in claim 7, wherein each of said arms has a pair of side edges being contoured such that a middle portion of each of said arms has a width less than a width of each of said proximal and distal ends, an area between said distal ends and said middle portions generally having a rectangular shape.

10. The clip device as in claim 7, wherein a cross-section of each of said teeth taken perpendicular to a plane of said arms generally has a triangular shape such that a base of each of said triangles is abutted against one of said distal ends.

11. The clip device as in claim 7, wherein said urging means comprises:

each of said arms having a middle portion positioned between said proximal and distal ends;

two pairs of protruding members, each pair of said protruding members being integrally coupled to and extending away from one of said middle portions of said arms, each protruding member in a pair of protruding members being spaced from each other, each of said protruding members having an aperture therein;

a rod extending through said apertures in each pair of protruding members such that said arms are pivotally coupled together;

a biasing means biases said proximal ends away from each other, said biasing means being wound about said rod.

* * * * *